US008935833B2

(12) United States Patent
Kaneko

(10) Patent No.: US 8,935,833 B2
(45) Date of Patent: Jan. 20, 2015

(54) CAM LOCK BUCKLE

(75) Inventor: Hitoshi Kaneko, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/877,727

(22) PCT Filed: Oct. 13, 2010

(86) PCT No.: PCT/JP2010/067917
§ 371 (c)(1),
(2), (4) Date: Apr. 4, 2013

(87) PCT Pub. No.: WO2012/049739
PCT Pub. Date: Apr. 19, 2012

(65) Prior Publication Data
US 2013/0185902 A1 Jul. 25, 2013

(51) Int. Cl.
*A44B 11/06* (2006.01)
*A44B 11/12* (2006.01)
*A44B 11/26* (2006.01)

(52) U.S. Cl.
CPC ..... *A44B 11/065* (2013.01); *A44B 11/12* (2013.01); *A44B 11/266* (2013.01)
USPC ..... 24/170; 24/323; 24/191

(58) Field of Classification Search
USPC ..... 24/170, 180, 191, 323, 324
See application file for complete search history.

(56) References Cited

U.S. PATENT DOCUMENTS 2,862,268 A * 12/1958 Cushman ..... 24/323
2,919,481 A * 1/1960 Finken et al. ..... 24/196
3,131,446 A * 5/1964 Davis ..... 24/323
3,249,386 A * 5/1966 Board et al. ..... 297/476
3,255,502 A * 6/1966 Hollins ..... 24/191
3,344,486 A * 10/1967 Eveland ..... 24/194
3,365,756 A * 1/1968 Bayon ..... 24/700
3,608,158 A * 9/1971 Bengtsson ..... 24/170

(Continued)

FOREIGN PATENT DOCUMENTS

JP 17-4780 Y1 4/1942
JP 97605/1984 7/1984

(Continued)

OTHER PUBLICATIONS

Office Action, Japanese Patent Application No. 2012-538497, mailed Oct. 1, 2013.

(Continued)

*Primary Examiner* — Robert J Sandy
*Assistant Examiner* — David Upchurch
(74) *Attorney, Agent, or Firm* — Kilpatrick Townsend & Stockton LLP

(57) ABSTRACT

In a cam lock buckle, a slide mechanism holds a movable member so that the movable member can slide between a first position at which a shaft is located close to a first end of an elongated hole and a second position at which the shaft is located close to a second end of the elongated hole. A gap defined between a holding portion and a bottom portion when the movable member is slid to the second position is narrower than a gap defined between the holding portion and the bottom portion when the movable member is slid to the first position. One of the holding portion and the bottom portion facing the holding portion is provided with a concave groove and the other of the holding portion and the bottom portion is provided with a convex tread that pushes a part of the belt into the concave groove.

3 Claims, 15 Drawing Sheets

(56) References Cited

U.S. PATENT DOCUMENTS

| | | | | | |
|---|---|---|---|---|---|
| 3,678,542 | A | * | 7/1972 | Prete, Jr. | 24/191 |
| 3,775,813 | A | * | 12/1973 | Higuchi | 24/323 |
| 3,852,855 | A | * | 12/1974 | Bengtsson | 24/265 EE |
| 4,631,784 | A | * | 12/1986 | Fildan | 24/170 |
| 4,726,625 | A | * | 2/1988 | Bougher | 297/483 |
| 4,891,866 | A | * | 1/1990 | Kasai | 24/170 |
| 4,937,923 | A | * | 7/1990 | McEntire | 24/647 |
| 5,161,351 | A | | 11/1992 | Woodruff | |
| 5,311,653 | A | * | 5/1994 | Merrick | 24/196 |
| 5,431,365 | A | * | 7/1995 | Hopkins | 248/683 |
| D377,155 | S | * | 1/1997 | Takimoto | D11/216 |
| 5,661,877 | A | * | 9/1997 | Bloomer | 24/170 |
| 5,732,448 | A | * | 3/1998 | Shields et al. | 24/180 |
| 6,381,810 | B2 | * | 5/2002 | Hsieh | 24/170 |
| 6,665,913 | B2 | * | 12/2003 | Kosh et al. | 24/193 |
| 6,877,189 | B2 | * | 4/2005 | Simonson et al. | 24/170 |

FOREIGN PATENT DOCUMENTS

| | | | |
|---|---|---|---|
| JP | 175107/1985 | | 11/1985 |
| JP | 10-196613 | A | 7/1998 |
| JP | 2007-229073 | A | 9/2007 |
| TW | M240109 | U | 8/2004 |
| TW | M276474 | U | 10/2005 |
| WO | 2011/039856 | A1 | 4/2011 |

OTHER PUBLICATIONS

International Search Report, PCT Application No. PCT/JP2010/067917, mailed Jan. 18, 2011.

Office Action, Taiwanese Patent Application No. 100114875, mailed Mar. 20, 2014.

* cited by examiner

CAM LOCK BUCKLE

This application is a national stage application of PCT/JP2010/067917 which is incorporated herein by reference.

TECHNICAL FIELD

The present invention relates to a cam lock buckle that is capable of adjusting a position of a belt while allowing a slide movement of the belt in a longitudinal direction and is adapted to lock the adjusted position of the belt.

BACKGROUND ART

A cam lock buckle that is capable of adjusting a position of a flat belt while allowing a slide movement of the belt in a longitudinal direction of the belt and is adapted to lock the adjusted position of the belt has been known.

For instance, Patent Literature 1 discloses a cam lock buckle that includes: a body having a U-shaped cross section provided by a bottom portion and rising walls on both sides of the bottom portion in a width direction; a fastening member attached to the rising walls of the body in a slidable and tillable manner; and a spring member for biasing the fastening member toward the bottom portion of the body.

A slide mechanism is provided by: an elongated hole that is provided on each of the rising walls of the body and is slanted to approach the bottom portion toward a first end of the body; and a shaft that is provided near an end of the fastening member and is engaged with the elongated hole in a turnable and slidable manner. The spring member is provided by a spring wire rod having both ends engaged with the rising walls of the body after being wound around the shaft and a central portion that biases the fastening member toward the bottom portion of the body. A tooth including parallel triangular projections are provided on a surface near the shaft of the slide mechanism facing the bottom portion of the body.

In the above arrangement, when a belt is inserted between the bottom portion of the body and the fastening member, the belt is pressed against the bottom portion of the body by the fastening member biased by the spring member. Then, since a friction resistance is high due to the contact of the belt and the fastening member via the tooth, when the belt is pulled toward the first end of the body (i.e. to a lower side of the slanted elongated hole), the fastening member slides in conjunction with the movement of the belt. In other words, the shaft of the fastening member is moved downward in the slanting direction along the elongated hole of the body. Then, since the gap between the bottom portion of the body and the fastening member is narrowed, the belt is locked between the bottom portion of the body and the fastening member.

CITATION LIST

Patent Literature

Patent Literature 1 U.S. Pat. No. 5,161,351

SUMMARY OF THE INVENTION

Problems to be Solved by the Invention

The cam lock buckle disclosed in the above-mentioned Patent Literature 1 requires the spring member in order to slide the fastening member in conjunction with the movement of the belt when the belt is pulled toward the first end of the body (i.e. to a lower side of the slanted elongated hole). In other words, without the spring member, the fastening member escapes upward. Thus, it is necessary to bias the fastening member toward the bottom of the body with the spring member. The necessity for providing the spring member results in an increase in the number of components.

Further, since the fastening member is pressed toward the bottom portion of the body with the spring member, in order to adjust the position of the belt, it is necessary to raise the spring member away from the fastening member, to raise the fastening member away from the bottom portion of the body and to pull the belt toward a second end (in a position-adjusting direction) of the body for the position adjustment while the spring member and the fastening member are raised.

If the belt is pulled in the position-adjusting direction while the fastening member is pressed toward the bottom portion of the body by the spring member, since the pressing force of the spring member is also applied on the belt via the fastening member, it is difficult to pull the belt (i.e. difficult to adjust the position of the belt) and the belt may be damaged according to the circumstances.

An object of the invention is to provide a cam lock buckle that is adapted to be constructed of less number of components, is less likely to cause a damage on a belt and is capable of easily performing the position adjustment of the belt.

Means for Solving the Problems

A cam lock buckle according to an aspect of the invention includes: a first member including a bottom portion and rising walls provided on both sides of the bottom portion in a width direction; a second member that is held by the first member being spaced apart from the bottom portion of the first member with a gap into which the belt is inserted, the second member including a holding portion for holding the belt against the bottom portion; and a slide mechanism comprising an elongated hole that is provided to one of the second member and the rising walls and a shaft that is provided to the other of the second member and the rising walls and is engaged with the elongated hole in a slidable manner, the slide mechanism holding the second member in a manner capable of slide movement between a first position at which the shaft is located close to a first end of the elongated hole and a second position at which the shaft is located close to a second end of the elongated hole, in which a gap defined between the holding portion and the bottom portion when the second member is slid to the second position is narrower than a gap defined between the holding portion and the bottom portion when the second member is slid to the first position, one of the holding portion and the bottom portion facing the holding portion is provided with a recess extending along an insertion direction of the belt, and the other of the holding portion and the bottom portion facing the holding portion is provided with a projection that pushes a part of the belt into the recess.

Herein, the term "a projection that pushes a part of the belt into the recess" does not require that the projection itself enters into the recess, but it is sufficient for the part of the belt to go inside relative to an opening face of the recess.

According to the above aspect of the invention, when the second member is slid to the first position at which the shaft is located close to the first end of the elongated hole, since the gap defined between the holding portion of the second member and the bottom portion of the first member is set wide, the belt can be longitudinally slid with less resistance against the second member and the first member.

In this state, the belt is pulled in a direction (lock direction) for the second member to slide from the first position to the second position. At this time, a part of the belt is sandwiched between the recess provided on one of the holding portion and the bottom portion and the projection provided on the other of the holding portion and the bottom portion. Accordingly, the second member is also slid to the second position in conjunction with the movement of the belt. At this time, since the gap defined between the holding portion and the bottom portion is set narrow at the second position, the belt is locked between the gap.

In contrast, when the belt is pulled in a direction for the second member to slide to the first position, the second member is also slid to the first position in conjunction with the movement of the belt. At this time, since the gap defined between the holding portion and the bottom portion is set wide at the first position, the locking of the belt is released, thereby allowing the position adjustment of the belt by sliding the belt. In other words, the belt can be slid with less resistance against the first member and the second member, so that the movement of the belt can be facilitated and the belt is less likely to be damaged.

Accordingly, in the above aspect of the invention, since one of the holding portion and the bottom portion facing the holding portion is provided with the recess and the other of the holding portion and the bottom portion is provided with the projection for pushing a part of the belt into the recess, the recess and the projection allowing the slide movement of the second member in the lock direction and anti-lock direction (i.e. in the direction for enabling the position adjustment) in conjunction with a pulling operation of the belt, the component such as a spring member can be omitted. Further, since the gap defined between the holding portion of the second member and the bottom portion of the first member is set wide when the second member is slid to the first position, the belt is less likely to be damaged and the position adjustment of the belt can be easily performed.

In the above aspect of the invention, it is preferable that the projection is provided by a convex tread extending along the insertion direction of the belt.

According to the above arrangement, provided that the projection is provided by the convex tread continuously extending in the insertion direction of the belt, the recess provided on one of the holding portion and the bottom portion can be kept facing the convex tread when the second member slides between the first position and the second position. Accordingly, since a part of the belt is always pushed into the recess, the second member can be slid in conjunction with the movement of the belt.

In the above aspect of the invention, it is preferable that the convex tread is configured so that a width of the convex tread is gradually enlarged and a gap against the holding portion is gradually narrowed in a direction for the second member to slide from the first position to the second position.

According to the above arrangement, provided that the convex tread is shaped so that the width of the convex tread is widened and the gap against the holding portion is gradually narrowed in the direction for the second member to slide from the first position to the second position, the gap between the recess and the convex tread is gradually narrowed when the second member slides from the first position to the second position, thereby further tightening the belt held in the gap. Thus, the belt can be reliably locked and the cam lock buckle can be used for a belt with various thicknesses.

In the above aspect of the invention, it is preferable that the bottom portion facing the holding portion is slanted toward the holding portion in the direction for the second member to slide from the first position to the second position.

According to the above arrangement, provided that the bottom portion facing the holding portion is slanted toward the holding portion in the direction for the second member slides from the first position to the second position, the gap defined between the holding portion and the bottom portion when the second member is slid to the second position can be reduced even when the elongated hole of the slide mechanism is not slanted or the slant angle of the elongated hole is set narrow. In other words, since the elongated hole is not necessarily slanted or the slant angle of the elongated hole can be reduced, the slide movement of the second member can be smoothly performed.

In the above aspect of the invention, it is preferable that a rise-prevention mechanism that prevents the second member from rising with the shaft as a fulcrum when the second member is closed relative to the first member is provided.

According to the above arrangement, since the rise-prevention mechanism prevents the second member from rising with the shaft as a fulcrum, slide adjustment of the belt can be performed while the second member is closed relative to the first member. Accordingly, the operability can be enhanced.

EXEMPLARY EMBODIMENT(S)

Figure 1:
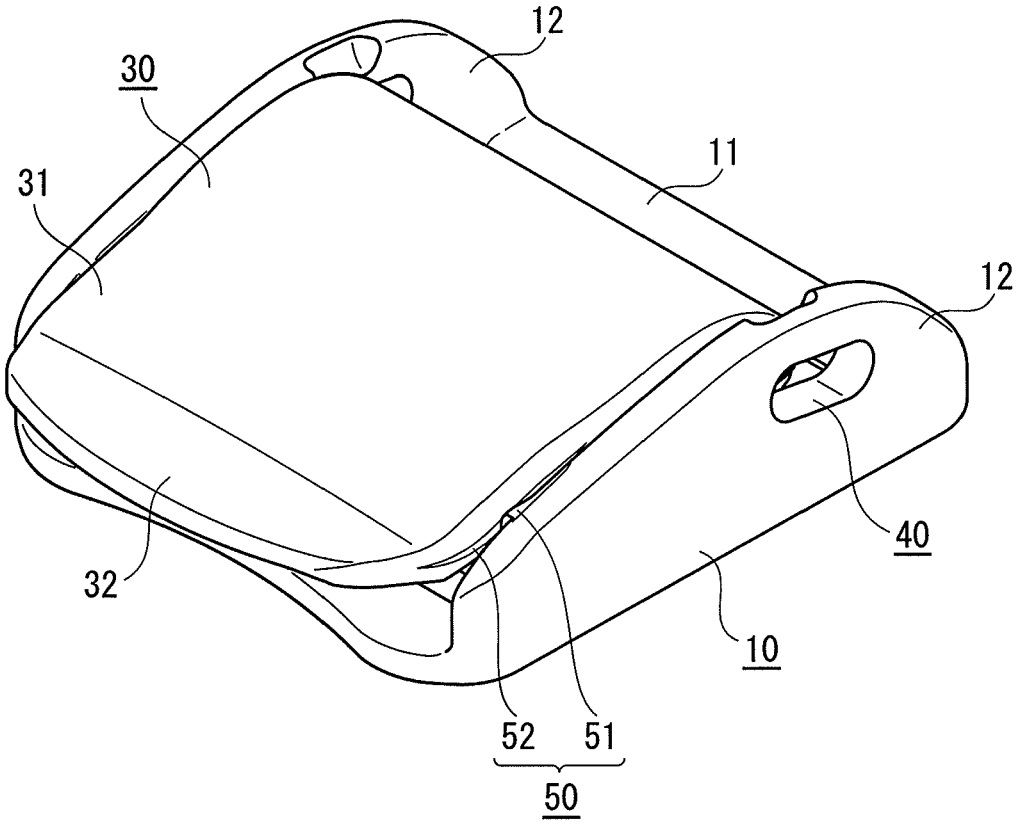
FIG. 1 is a perspective view showing an exterior of a cam lock buckle according to an exemplary embodiment of the invention.

Exemplary embodiment(s) of the invention will be described below with reference to the attached drawings.

Arrangement of Exemplary Embodiment

As shown in FIGS. 1 to 4, a cam lock buckle according to this exemplary embodiment includes: a synthetic-resin-made body 10 (first member); a synthetic-resin-made movable member 30 (second member) that is held by the body 10 while being spaced apart from a bottom portion 11 of the body 10 by a gap into which a first belt 1 is insertable, the movable member 30 having a holding portion 33 for holding the first belt 1 with the bottom portion 11; a slide mechanism 40 provided between the body 10 and the movable member 30, the slide mechanism 40 holding the movable member 30 in a slidable and tillable manner relative to the body 10; and a rise-prevention mechanism 50 provided between the body 10 and the movable member 30 to keep the movable member 30 from being raised.

It should be noted that, though the belt 1 herein is provided by a material of a certain level of elasticity (rigidity) (e.g. fiber woven in a belt-shape), the belt 1 may be made of any material. Further, the material of the body 10 and the movable member 30 may be metal instead of a synthetic resin.

Figure 3:
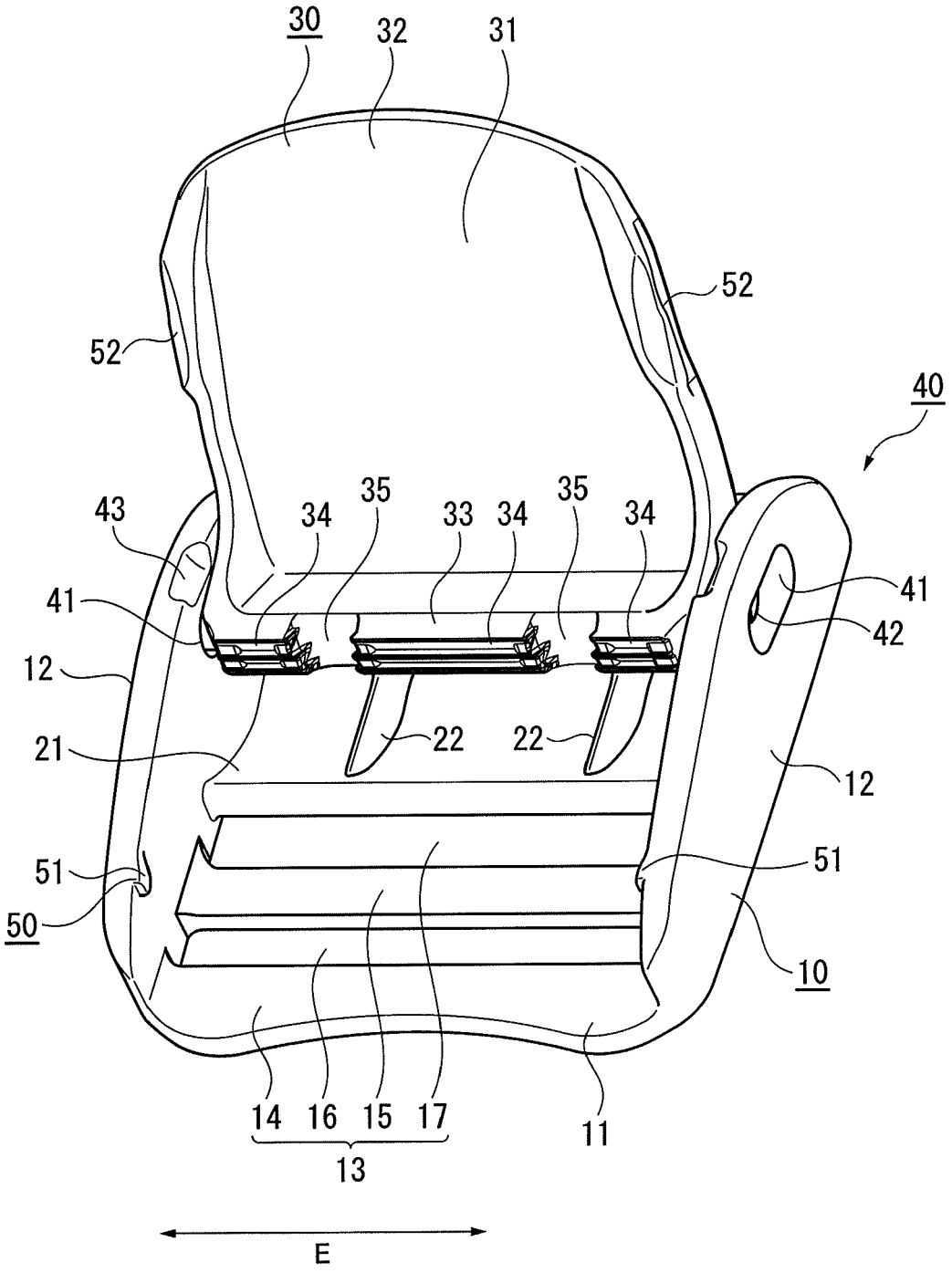
FIG. 3 is a perspective view showing the buckle according to the exemplary embodiment with a movable member being opened.
Figure 4:
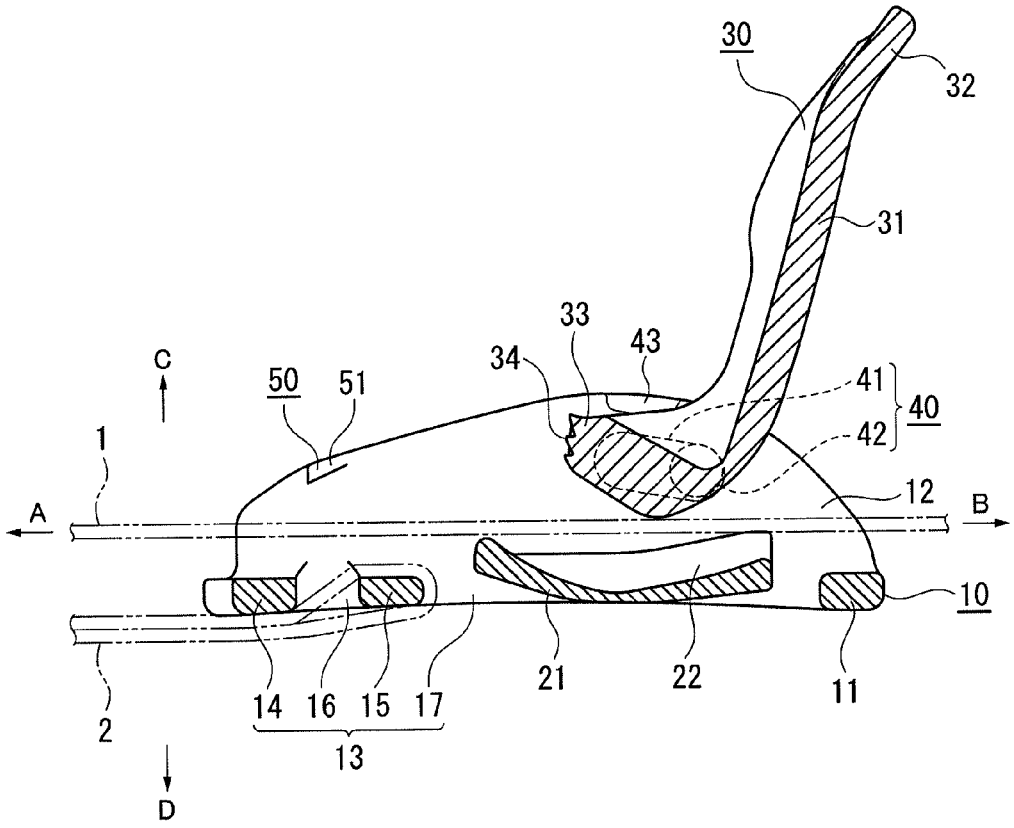
FIG. 4 is a cross section showing the buckle according to the exemplary embodiment with the movable member being opened.

Herein, A-B direction shown in FIG. 4 will be referred to as an insertion direction of the belt 1; C-D direction shown in FIG. 4 will be referred to as a top-bottom direction of the belt 1; and E direction shown in FIG. 3 will be referred to as a width direction.

Figure 5:
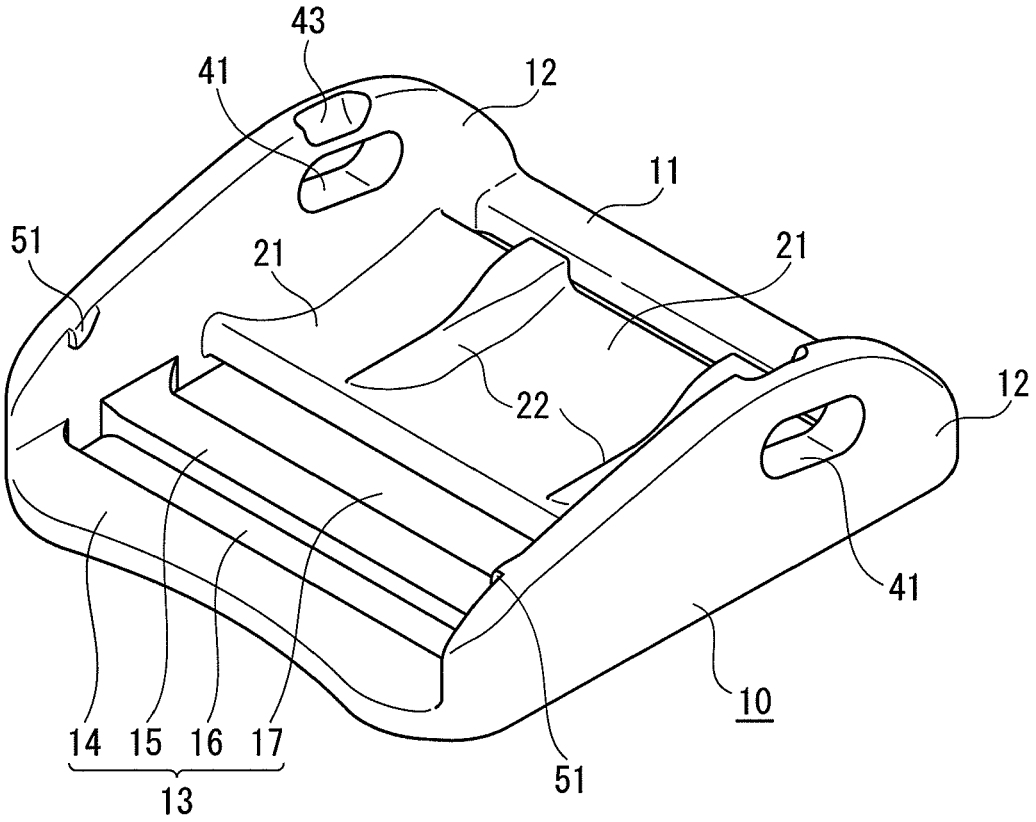
FIG. 5 is a perspective view showing a body according to the exemplary embodiment.
Figure 6:
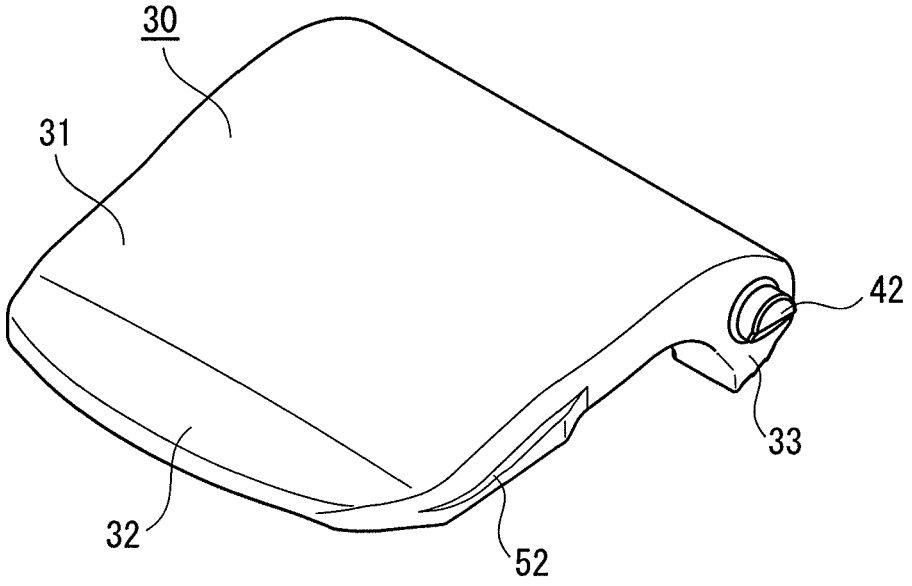
FIG. 6 is a perspective view showing the movable member according to the exemplary embodiment.
Figure 7:
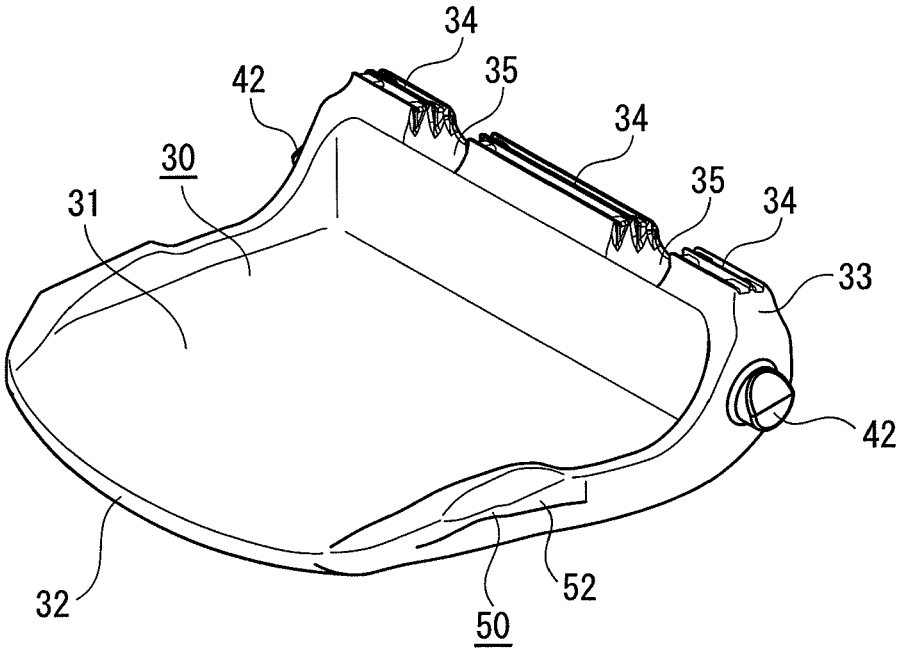
FIG. 7 is a perspective view showing the movable member being turned over in the exemplary embodiment.

As shown in FIGS. 3 to 5, the body 10 includes a rectangular plate-shaped bottom portion 11 and rising walls 12 perpendicularly and integrally standing upright from both sides of the bottom portion 11 in the width direction.

A belt attachment 13 for attaching the second belt 2 is provided near a first end of the bottom portion 11 while a second end of the bottom portion 11 serves as a belt-receiving section 21. The belt attachment 13 includes: a first connection shaft 14 and a second connection shaft 15 that are provided near the first end of the bottom portion 11 being spaced apart in the insertion direction of the first belt 1 and are extended between the rising walls 12 on both sides thereof; a first belt insertion hole 16 defined between the first and the second connection shafts 14 and 15; and a second belt insertion hole 17 defined between the second connection shaft 15 and the belt-receiving section 21. Accordingly, the second belt 2 is rigidly attached to the belt attachment 13 by drawing an end of the second belt 2 from a back side of the bottom portion 11 to a top side of the bottom portion 11 around the second connection shaft 15, drawing the end of the second belt 2 from the first belt insertion hole 16 to the back side of the bottom portion 11 and subsequently fixing to the second belt 2. The details of the belt-receiving section 21 will be described later.

As shown in FIGS. 3 to 4 and FIGS. 6 to 7, the movable member 30 includes: a rectangular plate-shaped cover 31 that has a width capable of being received in the space between the rising walls 12 of the body 10 and a length slightly shorter than the length of the body 10; a manipulation portion 32 provided at a first end of the cover 31; and a holding portion 33 that is integrally formed at a second end of the cover 31 in a manner substantially perpendicular to the cover 31.

The manipulation portion 32 has an arc-like profile so that, when the movable member 30 is closed relative to the body 10 (the state shown in FIG. 1), a central portion in the width direction protrude outward relative to the profile of the first connection shaft 14 of the body 10. Further, the manipulation portion 32 is slightly slanted upward relative to the cover 31.

A tooth 34 to be bitten into the first belt 1 are provided on an end face of the holding portion 33. The tooth 34 include a plurality of lines of projections that have substantially triangular cross section and are continuous in the width direction, the plurality of lines of projections being arranged in a direction orthogonal to the width direction.

As shown in FIGS. 3 and 4, the slide mechanism 40 includes elongated holes 41 each provided on each of the rising walls 12 on both sides of the body 10 and a shaft 42 that is integrally protruded from both sides of a base end of the holding portion 33 of the movable member 30 and is engaged with the elongated holes 41 in a slidable and turnable manner. The slide mechanism 40 holds the movable member 30 so that the movable member 30 is capable of slide movement between a first position in which the shaft 42 is located near a first end (on the left side in FIG. 4) of the elongated hole 41 and a second position in which the shaft 42 is located near a second end (on the right side in FIG. 4) of the elongated hole 41.

The second end of each of the elongated holes 41 is slanted relative to the first end (an end located closer to the center of the rising walls 12) toward the bottom portion 11 of the body 10. Thus, a gap (H2 in FIG. 10) defined between the holding portion 33 and the bottom portion 11 when the movable member 30 is slid to the second position becomes narrower than a gap (H1 in FIG. 8) defined between the holding portion 33 and the bottom portion 11 when the movable member 30 is slid to the first position.

Incidentally, an inclined surface 43 enlarging outward from an inner surface toward a top surface of the rising walls 12 is formed on each of the rising walls 12 at a part above the elongated hole 41. Thus, the shaft 42 of the movable member 30 can be smoothly guided into the elongated holes 41 with the use of the inclined surface 43.

Figure 2:
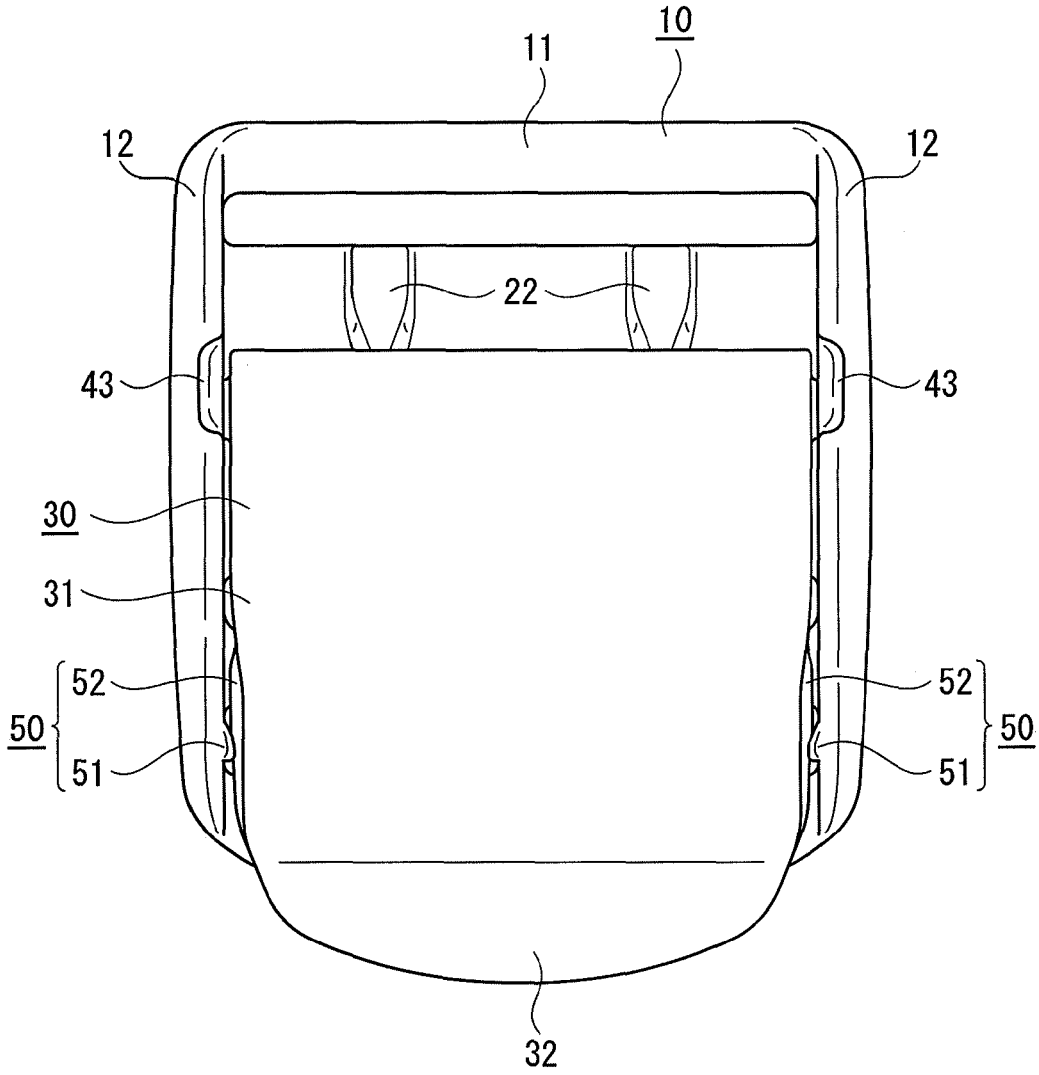
FIG. 2 is a plan view of the cam lock buckle according to the exemplary embodiment.

As shown in FIGS. 1 to 3, the rise-prevention mechanism 50 prevents the movable member 30 from being raised with the shaft 42 as a fulcrum (i.e. prevents the movable member 30 from being erected substantially orthogonally to the body 10) while the movable member 30 is closed relative to the body 10. The rise-prevention mechanism 50 includes engaging portions 51 provided on an inside of each of the rising walls 12 of the body 10 and engaged portions 52 each provided on both sides of the cover 31 of the movable member 30 to be engaged with the engaging portion 51.

Each of the engaging portions 51 is provided by a projection that gradually protrudes inward relative to the rising wall 12 from the upper surface of the rising wall 12 toward the bottom side to define an engagement surface parallel to the bottom portion 11.

Each of the engaged portions 52 is provided by a projection that gradually protrudes outward relative to the cover 31 from an inner surface of the cover 31 toward an outer side to define an engagement surface parallel to the cover 31.

Thus, when the movable member 30 is closed relative to the body 10, the engaged portion 52 comes in contact with the engaging portion 51. Further, when the movable member 30 is pressed in a direction for the movable member 30 to be closed, the engaged portion 52 goes beyond the engaging portion 51 to be engaged with the engagement surface of the engaging portion 51, whereby the rising of the movable member 30 is prevented.

As shown in FIGS. 3 to 7, one of the holding portion 33 of the movable member 30 and the bottom portion 11 of the body 10 facing the holding portion 33 (i.e. the belt-receiving section 21) is provided with a recess and the other one of the holding portion 33 and the belt-receiving section 21 facing thereto is provided with a projection for pushing a part of the first belt 1 into the recess. In this exemplary embodiment, the recess in a form of a concave groove 35 is provided on the holding portion 33, and the projection in a form of a convex tread 22 for pushing a part of the first belt 1 into the concave groove 35 is provided to the belt-receiving section 21.

The concave groove 35 is provided by two concave grooves of a rectangular cross section that are spaced apart in the width direction of the holding portion 33 and penetrates the holding portion 33 along the insertion direction of the first belt 1.

The convex tread 22 includes two convex treads that are provided on the belt-receiving section 21 facing the two concave grooves 35 and are continuous in the insertion direction of the first belt 1. The cross section of the convex tread 22 is triangular with an acute apex near the first end and, after being gradually enlarged in width in the direction for the movable member 30 to slide from the first position to the second position, the widened width is maintained. The height of the convex tread 22 may be defined in any manner as long as a part of the first belt 1 can be pushed into the concave groove 35. It is not necessary that, when the movable member 30 is slid to the first position, an end of the convex tread 22 enters into the concave groove 35. In other words, it is only necessary that a part of the first belt 1 securely enters the concave groove 35 (i.e. goes beyond a line connecting corners of open side of the concave groove 35).

The bottom portion 11 of the body 10 on which the convex tread 22 is provided, i.e. the belt-receiving section 21 facing the holding portion 33 of the movable member 30, is provided in a curved surface with both ends in the insertion direction of the first belt 1 being curved upward. In other words, the belt-receiving section 21 is slanted toward the holding portion 33 in a direction for the movable member 30 to slide from the first position to the second position.

Position-Adjustment Operation and Locking Operation of Belt

Figure 8:
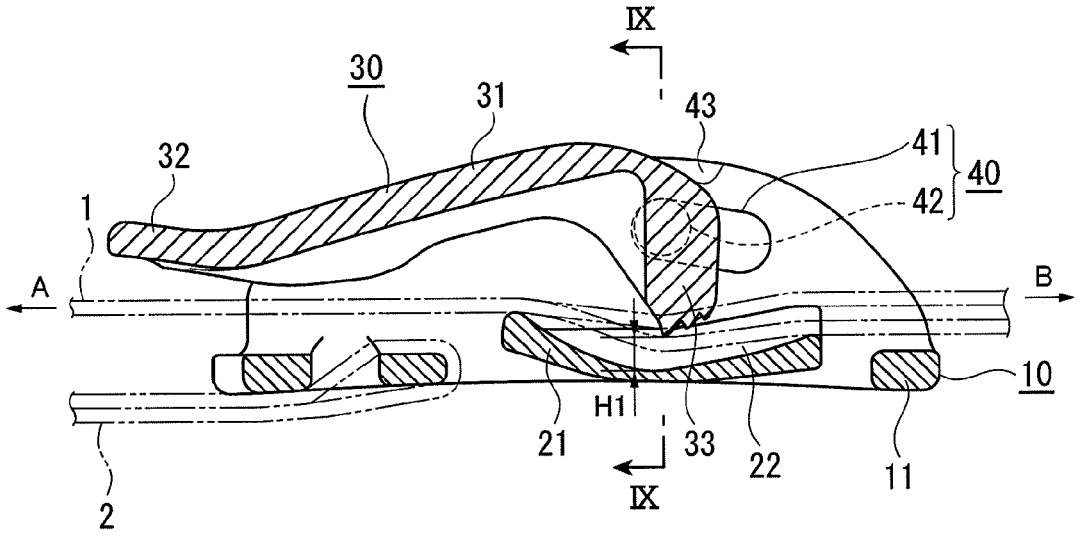
FIG. 8 is a cross section showing the movable member that is slid to a first position in the exemplary embodiment.

When movable member 30 is closed relative to the body 10 with the rise-prevention mechanism 50 and the movable member 30 is slid to the first position, i.e. when the movable member 30 is slid to the first position in which the shaft 42 is located close to the first end of the elongated hole 41, as shown in FIG. 8, since the gap H1 defined between the holding portion 33 of the movable member 30 and the belt-receiving section 21 of the body 10 is set wide, the fastening condition can be adjusted while the first belt 1 is slid in one longitudinal direction (the fastening direction A) with less resistance against the movable member 30 and the body 10.

Figure 9:
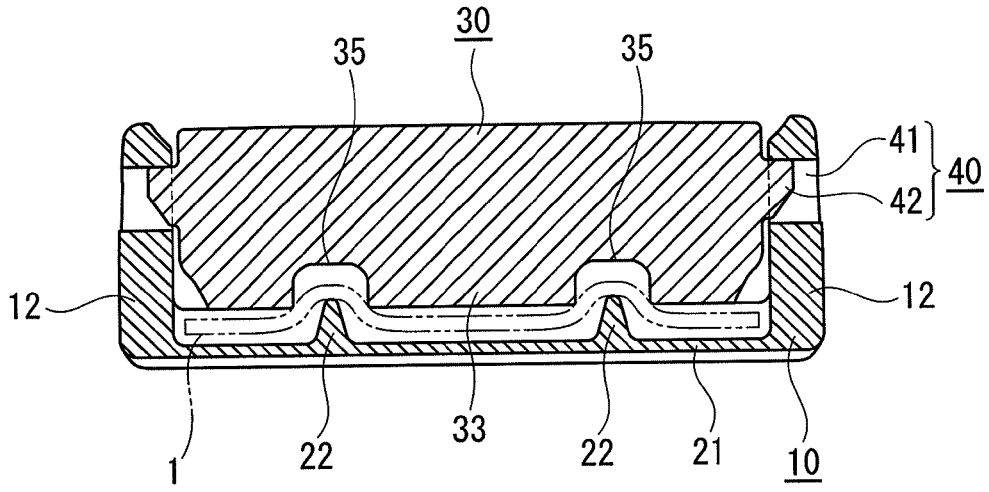
FIG. 9 is a cross section taken along IX-IX line in FIG. 8.

In this state, as shown in FIG. 9, a part of the first belt 1 is pushed into the concave groove 35 provided to the holding portion 33 with the convex tread 22 provided on the belt-receiving section 21 of the body 10.

Accordingly, when the first belt 1 is pulled in the other longitudinal direction (the lock direction B) in this state, the movable member 30 is slid in conjunction with the movement of the first belt 1. In other words, the shaft 42 of the movable member 30 is moved toward the second end of the elongated hole 41 and the movable member 30 is slid to the second position (see FIG. 10). At this time, since the gap H2 defined between the holding portion 33 and the belt-receiving section 21 is set narrow at the second position, the first belt 1 is locked between the gap H2 (see FIG. 11).

Figure 10:
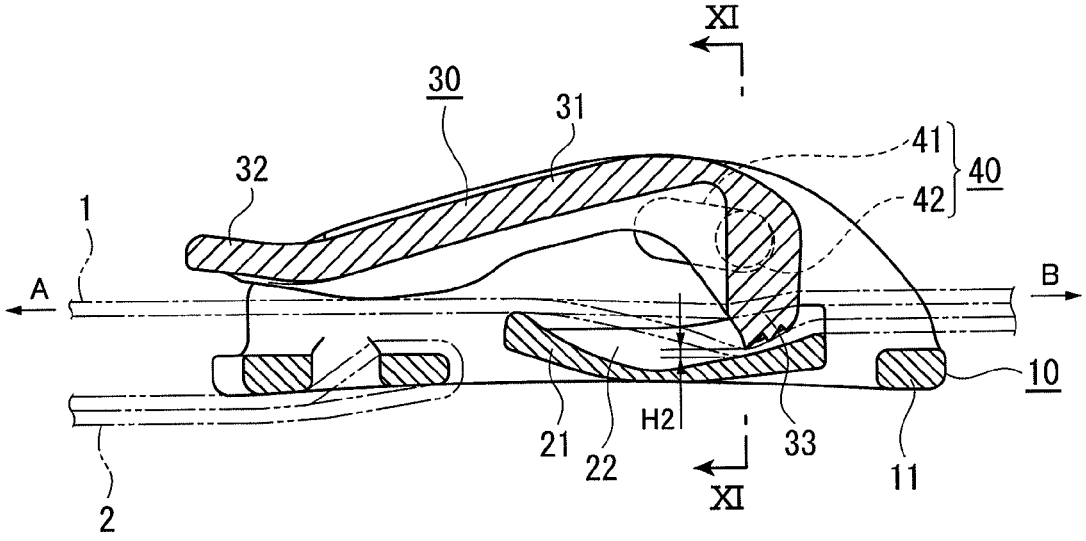
FIG. 10 is a cross section showing the movable member that is slid to a second position in the exemplary embodiment.
Figure 11:
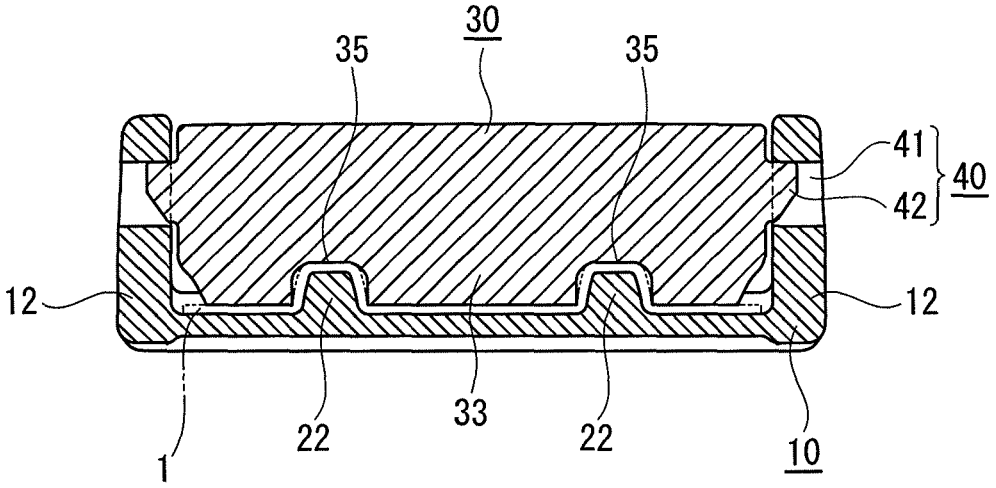
FIG. 11 is a cross section taken along XI-XI line in FIG. 10.

When the first belt 1 is pulled in the fastening direction A in the state shown in FIG. 10, the movable member 30 is also slid in conjunction with the movement of the first belt 1 from the second position to the first position. Then, at the first position, since the gap H1 defined between the holding portion 33 and the belt-receiving section 21 is set wide as shown in FIG. 8, the locked state of the first belt 1 is released and the fastening condition can be adjusted by sliding the first belt 1 in the fastening direction A.

Accordingly, when the first belt 1 is slid in the fastening direction A while the movable member 30 is closed relative to the body 10, the first belt 1 can be slid with less resistance against the body 10 and the movable member 30. Thus, the disadvantages such as a damage on the belt is not likely to occur and the fastening condition can be easily adjusted. In addition, the first belt 1 can be locked by pulling the first belt 1 in the lock direction B in this state, so that the locking operation can be facilitated.

Incidentally, in order to adjust the position of the first belt 1 in a direction for loosening the first belt 1, the manipulation portion 32 of the movable member 30 is raised relative to the body 10. Then, as shown in FIG. 4, the movable member 30 rises around the shaft 42 as a fulcrum, so that the holding portion 33 of the movable member 30 is separated from the belt-receiving section 21. In this state, since the gap between the belt-receiving section 21 of the body 10 and the movable member 30 is set wide, the length of the belt can be freely adjusted by pulling the first belt 1 in the B direction in FIG. 4.

Advantages of Exemplary Embodiment

According to this exemplary embodiment, the concave groove 35 is provided to the holding portion 33 of the movable member 30 and the convex tread 22 for pushing a part of the first belt 1 into the concave groove 35 is provided to the body 10. Since the concave groove 35 and the convex tread 22 allow the slide movement of the movable member 30 in the lock direction and in the fastening direction in conjunction with the pulling operation of the first belt 1, the number of components including the spring member can be reduced. Further, since the gap H1 defined between the holding portion 33 of the movable member 30 and the belt-receiving section 21 of the body 10 is set wide when the movable member 30 is slid to the first position, the first belt 1 is less likely to be damaged and the position adjustment of the first belt 1 can be easily performed.

Since the convex tread is provided by the convex tread 22 continuously extending in the insertion direction of the first belt 1, the concave groove 35 provided on the holding portion 33 can be kept facing the convex tread 22 when the movable member 30 slides between the first position and the second position. Accordingly, since a part of the first belt 1 is always pushed into the concave groove 35, the movable member 30 can be slid in conjunction with the movement of the first belt 1.

Further, since the convex tread 22 is shaped so that the width of the convex tread 22 is widened and the gap against the holding portion 33 is gradually narrowed in the direction for the movable member 30 to slide from the first position to the second position, the gap between the concave groove 35 and the convex tread 22 is gradually narrowed when the movable member 30 slides from the first position to the second position, thereby further tightening the first belt 1 held in the gap. Thus, the first belt 1 can be reliably locked and the cam lock buckle can be used for a belt with various thicknesses.

The both ends (in the insertion direction of the first belt 1: right-left direction in FIG. 4) of the belt-receiving section 21 facing the holding portion 33 are curved upward relative to a central portion thereof. In other words, the right half of the belt-receiving section 21 shown in FIG. 4 is slanted toward the holding portion 33 in a direction for the movable member 30 to slide from the first position to the second position. Accordingly, when the elongated hole 41 of the slide mechanism 40 is not slanted or when the slant angle of the elongated hole 41 is reduced, the gap defined between the holding portion 33 and the belt-receiving section 21 can be reduced when the movable member 30 is slid to the second position. Thus, since the slant angle of the elongated hole 41 can be reduced, the slide movement of the movable member 30 can be smoothly performed.

Further, since the left half of the belt-receiving section 21 shown in FIG. 4 is also configured so that the first end thereof is curved upward relative to the central portion of the belt-receiving section 21, the first belt 1 is stretched tense along the line connecting the left end of the belt-receiving section 21 and the holding portion 33 as shown in FIG. 10. Accordingly, the biting effect of the holding portion 33 can be enhanced and a large gripping force can be obtained when being locked.

The rise-prevention mechanism 50 can keep the movable member 30 from being raised with the shaft 42 as a fulcrum. Accordingly, since the slide adjustment of the first belt 1 can be performed while the movable member 30 is closed relative to the body 10, excellent operability can be obtained.

Since the cam lock buckle is provided by the two components (i.e. the body 10 and the movable member 30), the production cost and assembly cost of the components can be reduced.

Modifications

It should be understood that the scope of the present invention is not limited to the above-described exemplary embodiment(s) but includes modifications and improvements as long as the modifications and improvements are compatible with the invention.

Though the recess in a form of the two concave grooves 35 is provided to the holding portion 33 of the movable member 30 and the projection in a form of the two convex treads 22 is provided to the belt-receiving section 21 of the body 10, the locations of the recess and the projection may be reversed. Specifically, the same advantage can be expected when the projection in the form of the two convex treads 22 is provided to the holding portion 33 of the movable member 30 and the recess in the form of the two concave grooves 35 is provided to the belt-receiving section 21 of the body 10.

The number of the concave grooves 35 and the convex treads 22 is not limited to two but may be one or more than two.

Figure 12A:
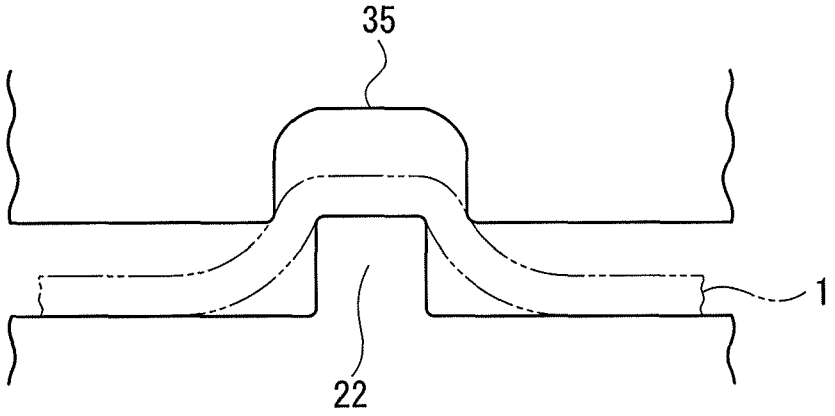
FIG. 12A illustrates a first modification of a recess and a projection in the exemplary embodiment.
Figure 12B:
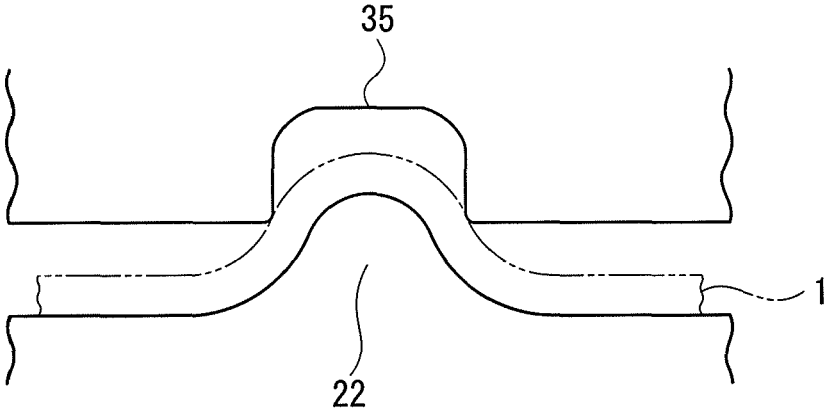
FIG. 12B illustrates a second modification of the recess and the projection in the exemplary embodiment.

The cross sectional shapes of the concave groove 35 and the convex tread 22 are also not limited to those described in the above exemplary embodiment. For instance, as shown in FIG. 12A, both of the concave groove 35 and the convex tread 22 may have a rectangular cross section. Alternatively, as shown in FIG. 12B, the convex tread 22 may be a projection having a raised (rounded chevron) cross section.

In addition, though the convex tread 22 extends continuously in the insertion direction of the first belt 1 in the exemplary embodiment, the convex tread 22 may be configured otherwise. For instance, the convex tread 22 may be divided along the insertion direction of the first belt 1 at a predetermined interval to provide line(s) of projections arranged at the predetermined interval. Alternatively, the convex tread 22 may be provided by a single projection concentrated at a single position.

Figure 13:
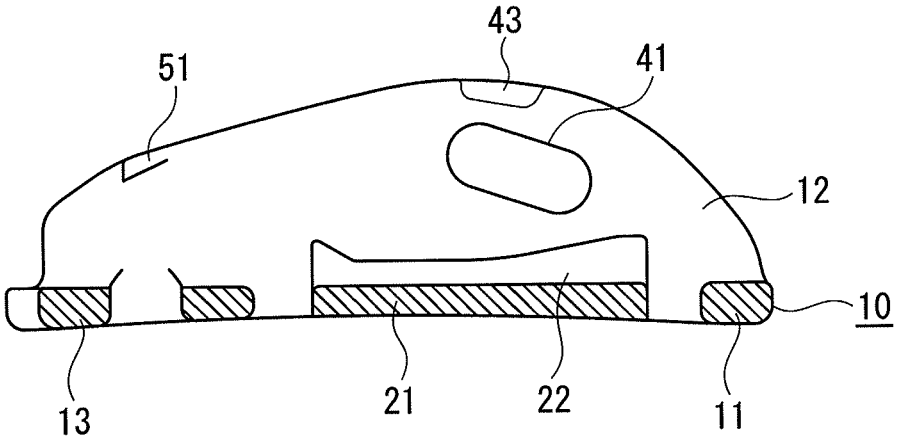
FIG. 13 is a cross section showing another modification of the exemplary embodiment in which a bottom portion of a body is made flat.

Though the belt-receiving section 21 of the body 10 is provided by a curved surface in the above exemplary embodiment, the belt-receiving section 21 may be configured otherwise. For instance, the belt-receiving section 21 of the body 10 may be provided as a flat belt-receiving section 21 as shown in FIG. 13. In this instance, since the space provided between the holding portion 33 of the movable member 30 and the belt-receiving section 21 defined when the movable member 30 is slid to the second position has to be narrowed, the slant angle of the elongated hole 41 should preferably be increased.

Figure 14:
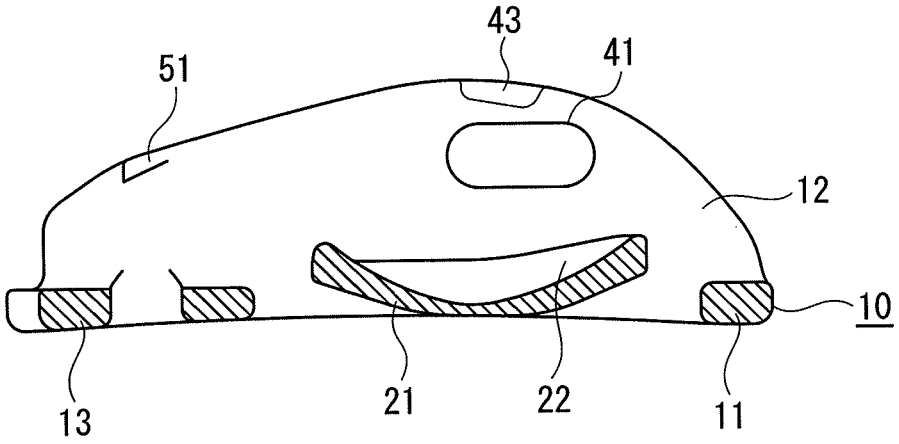
FIG. 14 is a cross section showing the body according to still another modification of the exemplary embodiment in which an elongated hole is made parallel to a belt-insertion direction.

In contrast, without slanting the elongated hole 41, the elongated hole 41 may be made parallel to the insertion direction of the first belt 1 and the belt-receiving section 21 may be provided by a curved surface or an inclined surface as shown in FIG. 14.

Though the engaging portion 51 is provided to the body 10 and the engaged portion 52 is provided to the movable member 30 to provide the rise-prevention mechanism 50 in the above exemplary embodiment, the rise-prevention mechanism 50 may be omitted. For instance, by inserting the first belt 1 into the inside of the movable member 30, the rise of the movable member 30 can be prevented by the first belt 1.

Though the slide mechanism 40 in the above exemplary embodiment is provided by the elongated hole 41 formed on each of the rising walls 12 of the body 10 and the shaft 42 provided to the movable member 30, the elongated hole 41 and the shaft 42 may be reversed. Specifically, the combination of the shaft 42 provided on each of the rising walls 12 of the body 10 and the elongated holes 41 provided to the movable member 30 would exhibit similar effects. The elongated hole 41 may be a blind hole (depression) instead of a through hole.

Figure 15:
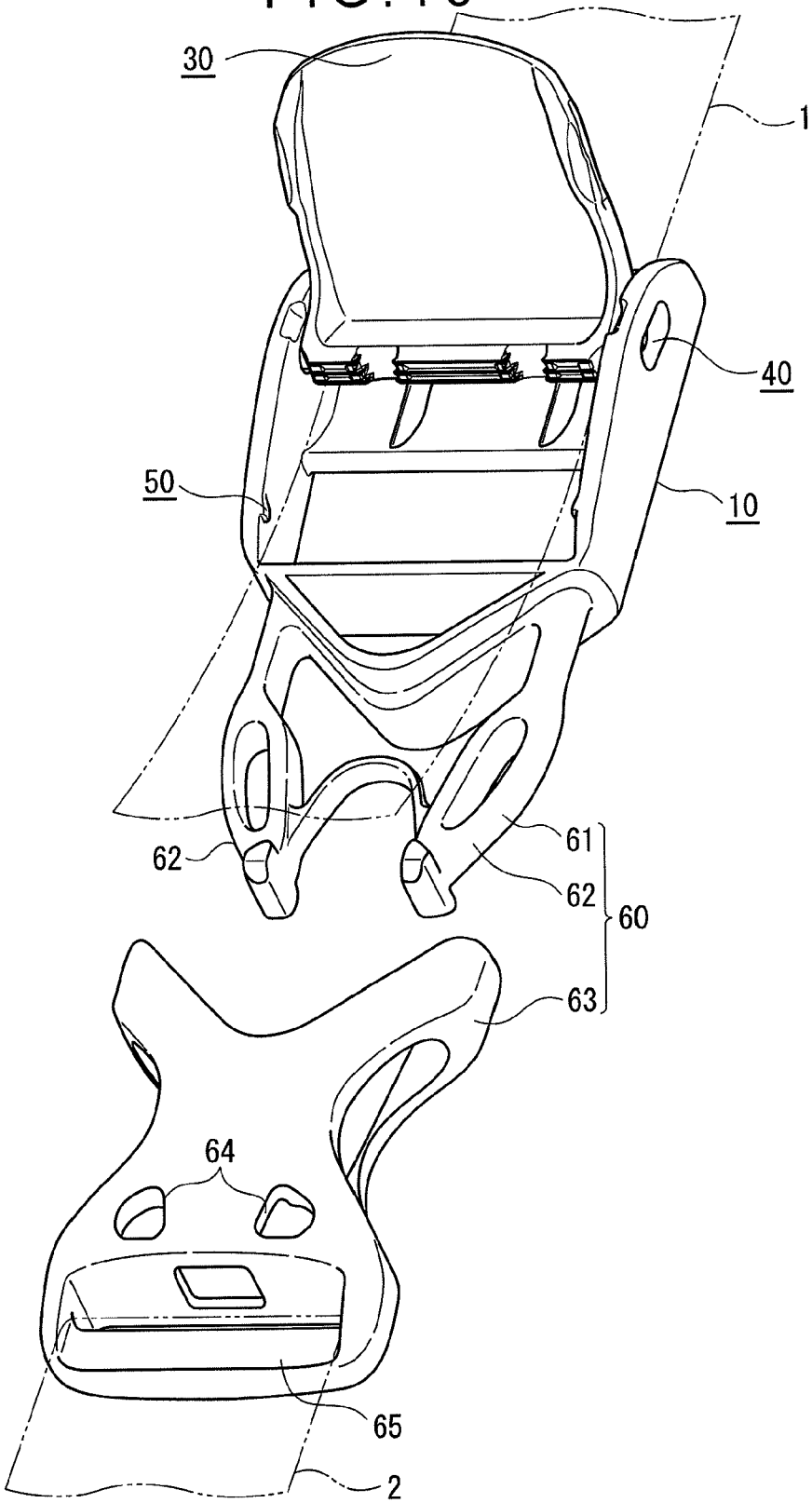
FIG. 15 is a perspective view showing a further modification of the exemplary embodiment in which a belt attachment of the body is modified into a buckle.

Though the belt attachment 13 is provided to the body 10 to attach the second belt 2 in the above exemplary embodiment, other arrangement is possible. For instance, as shown in FIG. 15, one of components of a buckle 60 including a plug 61 and a socket 63 to which the plug 61 is detachably attached, for instance, the plug 61, may be integrated with the body 10. The plug 61 includes a pair of legs 62. The socket 63 includes an engaging portion 64 for the legs 62 to be inserted and engaged and a belt attachment 65 for the second belt 2 to be attached. Thus, by engaging the plug 61 with the socket 63, the second belt 2 can be detachably attached to the body 10.

Further, the belt attachment 13 of the body 10 may be omitted and the body 10 may be directly fixed to an adherend such as a bag.

The invention claimed is:

1. A cam lock buckle comprising:

a first member comprising a bottom portion and rising walls provided on both sides of the bottom portion in a width direction;

a second member that is held by the first member being spaced apart from the bottom portion of the first member with a gap into which the belt is inserted, the second member comprising a holding portion for holding the belt against the bottom portion; and a slide mechanism comprising an elongated hole that is provided to one of the second member and the rising walls and a shaft that is provided to the other of the second member and the rising walls and is engaged with the elongated hole in a slidable manner, the slide mechanism holding the second member in a manner capable of slide movement between a first position at which the shaft is located close to a first end of the elongated hole and a second position at which the shaft is located close to a second end of the elongated hole, wherein a gap defined between the holding portion and the bottom portion when the second member is slid to the second position is narrower than a gap defined between the holding portion and the bottom portion when the second member is slid to the first position, one of the holding portion and the bottom portion facing the holding portion is provided with a recess extending along an insertion direction of the belt, and the other of the holding portion and the bottom portion facing the holding portion is provided with a projection that pushes a part of the belt into the recess, wherein the projection is provided by a convex tread extending along the insertion direction of the belt, wherein the convex tread is configured so that a width of the convex tread is gradually enlarged as the convex tread extends in the insertion direction and a gap against the holding portion gradually narrows when the second member slides from the first position to the second position.

2. The cam lock buckle according to claim 1, wherein the bottom portion facing the holding portion is slanted toward the holding portion in the direction for the second member to slide from the first position to the second position.

3. The cam lock buckle according to claim 1, further comprising a rise-prevention mechanism that prevents the second member from rising with the shaft as a fulcrum when the second member is closed relative to the first member.

* * * * *

UNITED STATES PATENT AND TRADEMARK OFFICE

CERTIFICATE OF CORRECTION

PATENT NO. : 8,935,833 B2
APPLICATION NO. : 13/877727
DATED : January 20, 2015
INVENTOR(S) : Hitoshi Kaneko It is certified that error appears in the above-identified patent and that said Letters Patent is hereby corrected as shown below:

In the Specification,

In column 1, line 24, delete “tillable” and insert -- tiltable --, therefor.

In column 5, line 16, delete “tillable” and insert -- tiltable --, therefor.

In column 10, lines 28-36, delete “For instance, as shown in FIG. 15, one of components of a buckle 60 including a plug 61 and a socket 63 to which the plug 61 is detachably attached, for instance, the plug 61, may be integrated with the body 10. The plug 61 includes a pair of legs 62. The socket 63 includes an engaging portion 64 for the legs 62 to be inserted and engaged and a belt attachment 65 for the second belt 2 to be attached. Thus, by engaging the plug 61 with the socket 63, the second belt 2 can be detachably attached to the body 10.” and insert the same on Col. 10, Line 29 as a new paragraph.

Signed and Sealed this
Twelfth Day of May, 2015

Michelle K. Lee

Michelle K. Lee
*Director of the United States Patent and Trademark Office*